US006731259B2

(12) United States Patent
Yer et al.

(10) Patent No.: US 6,731,259 B2
(45) Date of Patent: May 4, 2004

(54) DRIVING CIRCUIT OF A LIQUID CRYSTAL DISPLAY DEVICE

(75) Inventors: Jung Taeck Yer, Kyongsangbuk-do (KR); Sin Ho Kang, Kyonggi-do (KR); Jong Dae Kim, Kyongsangbuk-do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 270 days.

(21) Appl. No.: 10/029,196

(22) Filed: Dec. 28, 2001

(65) Prior Publication Data

US 2002/0109655 A1 Aug. 15, 2002

(30) Foreign Application Priority Data

Dec. 28, 2000 (KR) ..... 2000-84114

(51) Int. Cl.[7] ..... G09G 3/36
(52) U.S. Cl. ..... 345/89; 345/94; 345/98
(58) Field of Search ..... 345/87, 89, 94, 345/98, 99, 100, 101; 348/673, 687, 254, 255

(56) References Cited

U.S. PATENT DOCUMENTS 5,088,806 A * 2/1992 McCartney et al. ..... 345/101
6,121,950 A * 9/2000 Zavracky et al. ..... 345/101
6,137,462 A * 10/2000 Kim ..... 345/94
6,388,716 B1 * 5/2002 Tsuzuki et al. ..... 348/687
6,593,934 B1 * 7/2003 Yang et al. ..... 345/590

* cited by examiner

*Primary Examiner*—Kent Chang
(74) *Attorney, Agent, or Firm*—Birch, Stewart, Kolasch & Birch, LLP

(57) ABSTRACT

A driving circuit of an LCD device compensates a gamma voltage according to a peripheral environment so that exact picture images can be displayed. The driving circuit of the LCD device includes a memory dividing the peripheral environment into a plurality of modes and storing information of each mode, an environment sensor sensing variation of the peripheral environment, a controller selecting information of a mode corresponding to the resultant value sensed by the environment sensor, a digital variable resistor adjusting a resistance value to correspond to mode information selected by the controller, and a gamma voltage outputting unit outputting a plurality of gamma voltages corresponding to the adjusted resistance value.

20 Claims, 8 Drawing Sheets

DRIVING CIRCUIT OF A LIQUID CRYSTAL DISPLAY DEVICE

This application claims the benefit of the Korean Application No. P2000-84114 filed on Dec. 28, 2000, which is hereby incorporated by reference.

BACKGROUND OF THE INVENTION

1. Field of the Invention

The present invention relates to a liquid crystal display (LCD) device, and more particularly, to a driving circuit of a LCD device.

2. Discussion of the Related Art

Generally, an LCD device includes two glass substrates and a liquid crystal layer sealed between them. A thin film transistor (TFT)-LCD is used as a switching element that switches a signal voltage in the liquid crystal layer.

As shown in FIG. 1, the TFT-LCD includes a lower glass substrate 1 provided with a TFT as a switching element, an upper glass substrate 2 provided with a color filter, and a liquid crystal layer 3 injected between the two glass substrates 1 and 2. The TFT-LCD is a non-light-emitting device that obtains an image effect based on the electro-optical characteristics of the liquid crystal layer.

The lower glass substrate 1 includes TFT arrays 4. The upper glass substrate 2 includes a black matrix 5, a color filter layer 6, a common electrode 7, and an alignment film 8.

The lower glass substrate 1 and the upper glass substrate 2 are attached to each other by a sealant 9 such as epoxy resin. A driving circuit 11 on a printed circuit board (PCB) 10 is connected with the lower glass substrate 1 through a tape carrier package (TCP) 12.

A module of the aforementioned LCD includes four elements. The four elements of the LCD module includes a LCD panel with a liquid crystal injected between two substrates, a driver for driving the LCD panel, a PCB provided with various circuit elements, and an external structure having a back light 13.

A driving circuit of a related art LCD device will be described with reference to FIG. 2, which is a block diagram of a related art LCD device.

As shown in FIG. 2, the related art LCD device includes a LCD panel 21, a gate driver 22, a source driver 23, a gamma voltage generator 24, and a timing controller 25. In the LCD panel 21, a plurality of gate lines are arranged to cross a plurality of data lines. A TFT and a pixel electrode are arranged at each crossing portion of the gate and data lines. The gate driver 22 sequentially applies a driving signal to the gate lines. The source driver 23 applies a data signal to the data lines. The gamma voltage generator 24 applies a reference voltage to the source driver 23. The timing controller 25 applies various control signals and voltages to the gate driver 22 and the source driver 23.

In the aforementioned LCD device, light irradiated from a back light (not shown) passes through each of R (red), G (green), and B (blue) color filters in accordance with a voltage applied to each pixel electrode of the LCD panel 21, thereby displaying picture images.

To maintain a stable display quality of the LCD device, an exact and uniform gamma voltage is required. The gamma voltage is generated by a resistance string having a plurality of serially arranged resistors. The gamma voltage is divided to adapt to the transmittivity characteristic of the liquid crystal panel and to obtain a required gray level.

FIG. 3 is a detailed schematic view of the gamma voltage generator of FIG. 2.

The related art LCD device is based on a dot inversion method, in which digital data has 6 bits.

As shown in FIG. 3, the related art gamma voltage generator includes two voltage strings 33 and 35 arranged in parallel between a power source voltage terminal Vdd and a ground voltage terminal Vss, and an amplifier portion 37.

The respective voltage strings 33 and 35 include a plurality of resistors R1–R6 and R7–R12 serially connected to generate a plurality of gamma voltages through voltage division by the respective resistors.

The plurality of gamma voltages generated by the respective voltage strings 33 and 35 are amplified by a corresponding amplifier of the amplifier portion 37. Then the voltages are finally transmitted to the source driver 23.

For example, as shown in FIG. 3, the first voltage string 33 includes six serially connected resistors that outputs five voltage sources V1–V5 through voltage division by the respective resistors. The second voltage string 35 also includes six serially connected resistors that outputs five voltage sources V6–V10 through voltage division by the respective resistors.

The voltage sources V1–V10 are respectively transmitted to an input terminal at one side of a corresponding amplifier, where their noise is removed, and then output to the panel.

In the aforementioned gamma voltage generator, if a power source voltage Vdd is input, gamma voltages from V1 to V10 are set by serially connected resistance values. At this time, gray voltages of a positive frame are set as the voltages from V1 to V5 while gray voltages of a negative frame are set as the voltages from V6 to V10.

Meanwhile, R, G, and B digital data input to the source driver 23, as shown in a waveform of FIG. 4, are converted to analog-type voltage waveforms which will be applied to the LCD panel 21. Then, the converted data are applied to each pixel electrode.

The source driver 23 will be described in more detail with reference to FIG. 5, which is a block diagram of the source driver.

As shown in FIG. 5, the source driver includes a shift register 51, a sampling latch 52, a holding latch 53, a digital to analog (D/A) converter 54, and an amplifier 55.

The shift register 51 shifts a horizontal synchronizing signal through a source pulse clock HCLK and outputs a latch clock to the sampling latch 52.

The sampling latch 52 samples the R, G, and B digital data for each column line (data line) in accordance with the latch clock output from the shift register 51, and then latches the sampled R, G, and B data.

The holding latch 53 latches the R, G, and B data latched by the sampling latch 52 through a load signal LD.

The D/A converter 54 converts the R, G, and B digital data latched by the holding latch 53 to analog signals.

The amplifier 55 amplifies the R, G, and B data converted to analog signals at a certain width and outputs the amplified R, G, and B data to each data line of the LCD panel.

The source driver 23 samples and holds the R, G, and B digital data during 1 horizontal period, converts them to analog data, and amplifies the converted analog data at a certain width. If the holding latch 53 holds the R, G, and B data to be applied to nth data line, the sampling latch 52 samples the R, G, and B data to be applied to (n+1) data line.

The operation of the aforementioned related art driving circuit of the LCD device will be described below.

A video card (not shown) outputs R, G, and B digital data output to input to the source driver 23 without processing. The source driver 23, controlled by the timing controller 25, converts the R, G, and B digital data to analog signals that can be applied to the LCD panel 21, and outputs the resultant values to each data line.

At this time, the gamma voltages obtained by voltage division through resistors are output from the gamma voltage generator 24 to the source driver 23. The gamma voltages are varied depending on the LCD module.

If the gamma voltages are input to the source driver 23, the same voltage is applied to each of R, G, and B pixel electrodes, and the liquid crystal is driven depending on the applied voltage to obtain corresponding brightness of light.

FIG. 6 shows a gray curve obtained by a fixed gamma voltage according to the related art, and FIG. 7 shows a voltage type applied to the LCD panel 21 according to a gray scale by a reference voltage of a gamma voltage generator and a resistor string of the related art source driver 23.

However, the related art driving circuit of the LCD device has several problems.

Among these problems, the related art luminance voltage characteristic does not adapt to variation of peripheral luminous intensity and user's requests due to a gamma voltage being initially set according to the LCD module. For this reason, a problem arises in that various picture images cannot be displayed.

SUMMARY OF THE INVENTION

Accordingly, the present invention is directed to a driving circuit of an LCD device that substantially solves one or more problems due to limitations and disadvantages of the related art.

The invention, in part, provides a driving circuit of an LCD device in which a gamma voltage can be compensated according to a peripheral environment so that exact picture images can be displayed.

The invention, in part, provides a driving circuit of a LCD device that includes a memory dividing the peripheral environment into a plurality of modes and storing information of each mode, an environment sensor sensing variation of the peripheral environment, a controller selecting information of a mode corresponding to the resultant value sensed by the environment sensor, a digital variable resistor adjusting a resistance value to correspond to mode information selected by the controller, and a gamma voltage outputting unit outputting a plurality of gamma voltages corresponding to the resistance value adjusted by the digital variable resistor. An inverter can be connected to the controller. The memory can be an EEPROM.

The invention, in part, pertains to the digital variable resistor and the gamma voltage outputting unit comprising a programmable gamma voltage generator. The memory is provided either outside or inside the programmable gamma voltage generator. When the digital data has 6 bits, then 10 gamma voltages are generated. Also, the gamma voltages are applied to R, G and B pixel electrodes.

In the driving circuit of the LCD device according to the present invention, all of information for the peripheral environment (luminous intensity) are stored, and information corresponding to the current peripheral environment is output to compensate a corresponding gamma voltage, thereby exactly displaying various picture images.

The invention, in part, pertains to a LCD device which has a liquid crystal display and a source driver driving the liquid crystal display. A memory divides a peripheral environment into a plurality of modes and stores information of each mode. An environment sensor senses variation of the peripheral environment, and a controller selects information of a mode corresponding to the resultant value sensed by the environment sensor among information of each mode. An inverter is connected to the controller, and a digital variable resistor adjusting a resistance value to correspond to mode information selected by the controller. A gamma voltage outputting unit outputs a plurality of gamma voltages corresponding to the resistance value adjusted by the digital variable resistor.

The invention, in part, pertains to a method for driving a LCD device, which includes dividing a peripheral environment with a memory into a plurality of modes and storing information of each mode, sensing variation of the peripheral environment with an environment sensor, selecting, with a controller, information of a mode corresponding to the resultant value sensed by the environment sensor, adjusting a resistance value using a digital variable resistor to correspond to mode information selected by the controller, and outputting a plurality of gamma voltages corresponding to the resistance value adjusted by the digital variable resistor, the outputting being performed with a gamma voltage outputting unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings are included to provide a further understanding of the invention. The drawings illustrate embodiments of the invention and together with the description serve to explain the principles of the embodiments of the invention.

DETAILED DESCRIPTION OF THE INVENTION

Advantages of the present invention will become more apparent from the detailed description given herein after.

However, it should be understood that the detailed description and specific examples, while indicating preferred embodiments of the invention, are given by way of illustration only, since various changes and modifications within the spirit and scope of the invention will become apparent to those skilled in the art from this detailed description.

Reference will now be made in detail to the preferred embodiments of the present invention, examples of which are illustrated in the accompanying drawings. Wherever possible, the same reference numbers will be used throughout the drawings to refer to the same or like parts.

Figure 1:
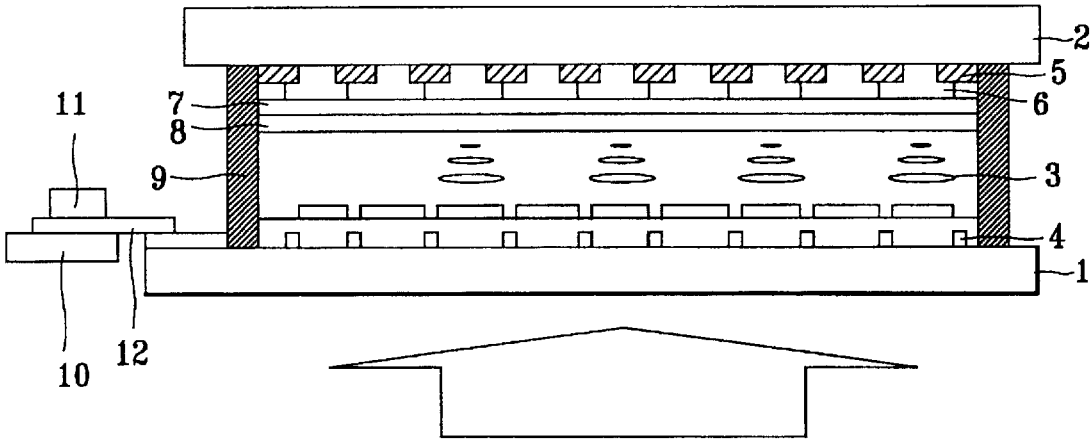
FIG. 1 Related Art
FIG. 1 is a sectional view of a LCD device.
Figure 2:
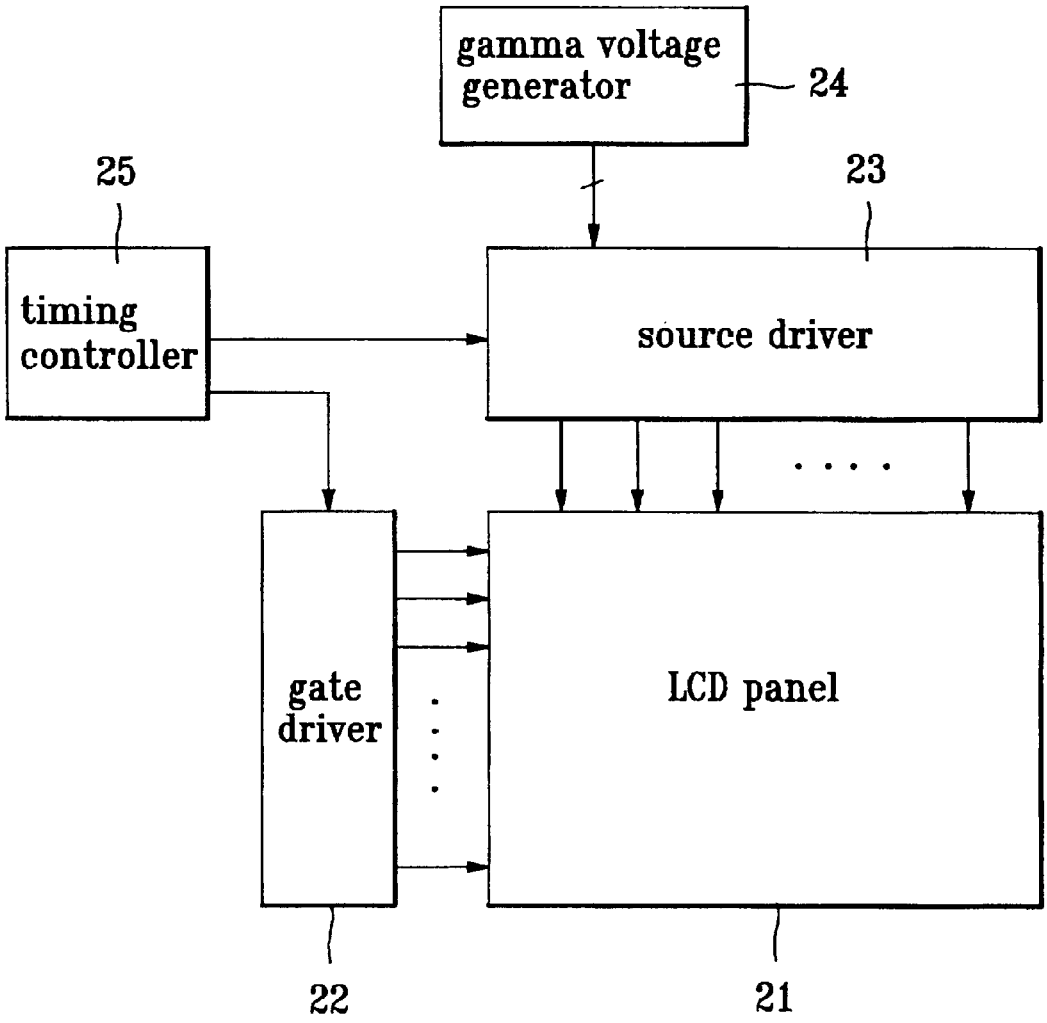
FIG. 2 Related Art
FIG. 2 is a schematic view of a related art driving circuit of a LCD device.
Figure 3:
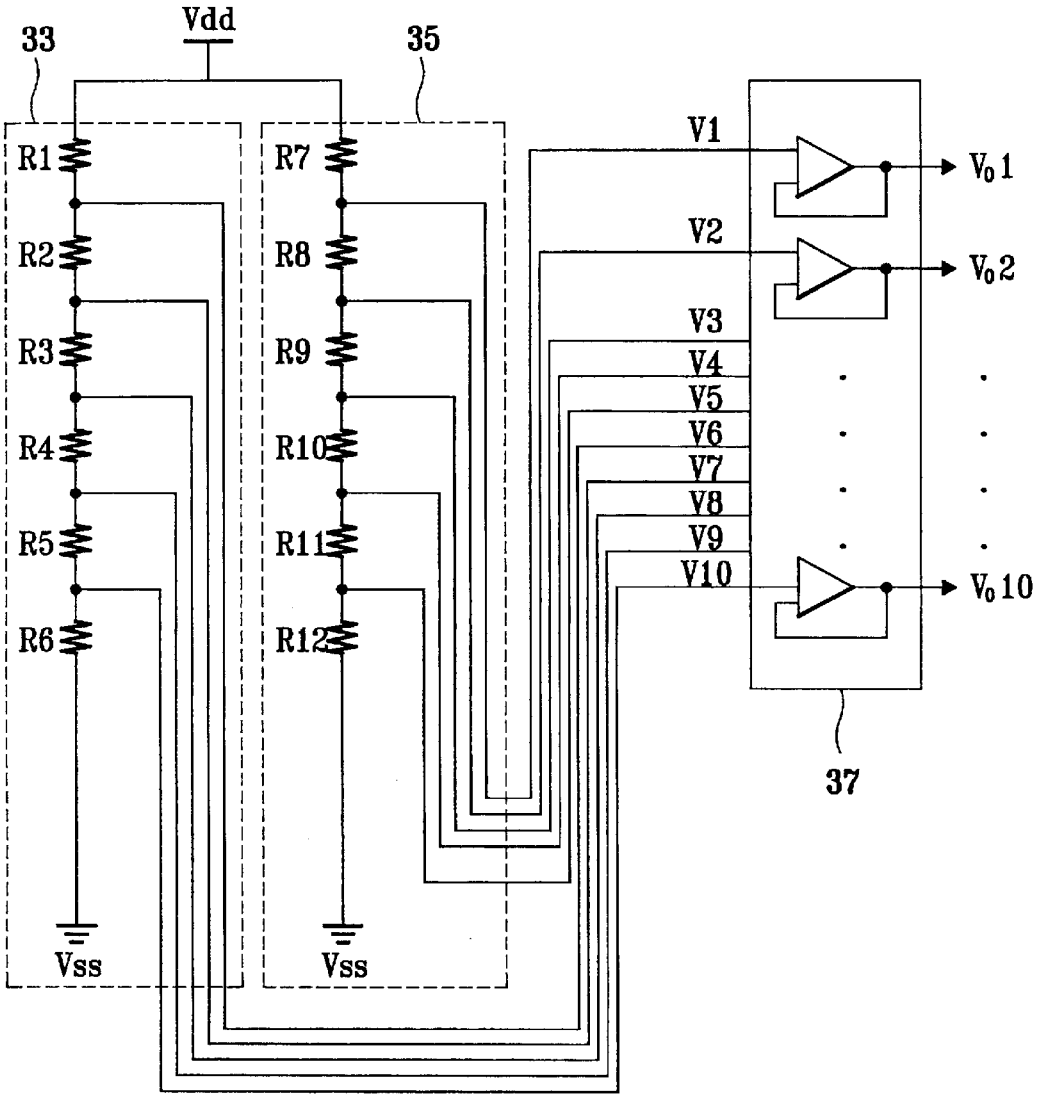
FIG. 3 Related Art
FIG. 3 is a detailed schematic view of a gamma voltage generator of FIG. 2.
Figure 4:
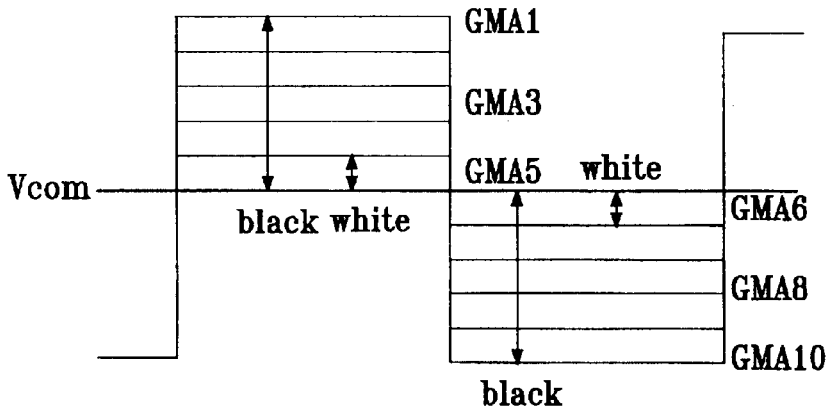
FIG. 4 Related Art
FIG. 4 is a voltage waveform of a source driver of FIG. 2.
Figure 5:
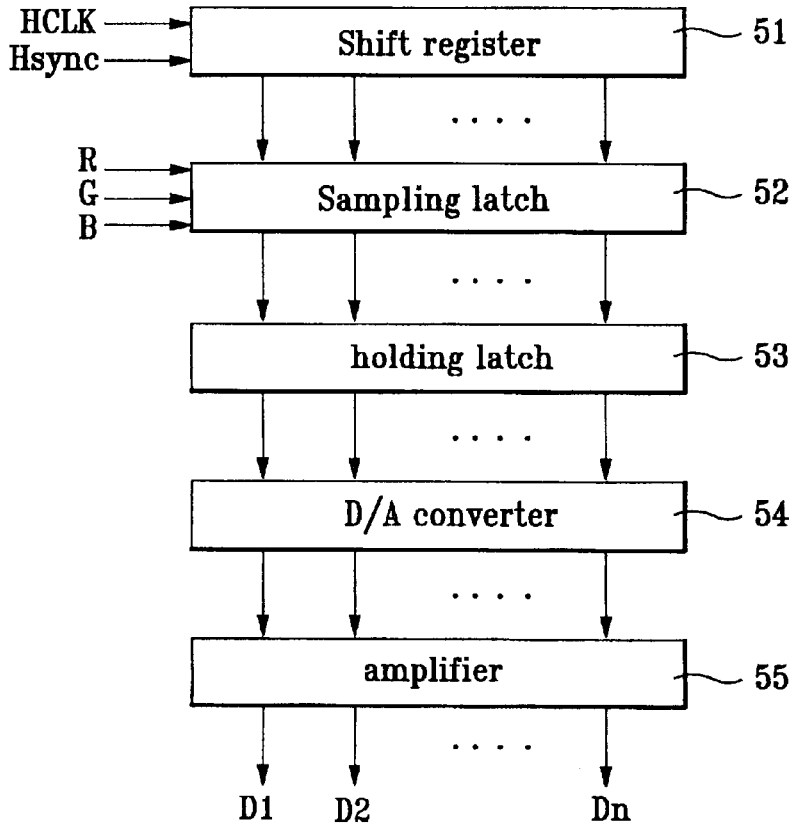
FIG. 5 Related Art
FIG. 5 is a schematic view of a source driver of FIG. 2.
Figure 6:
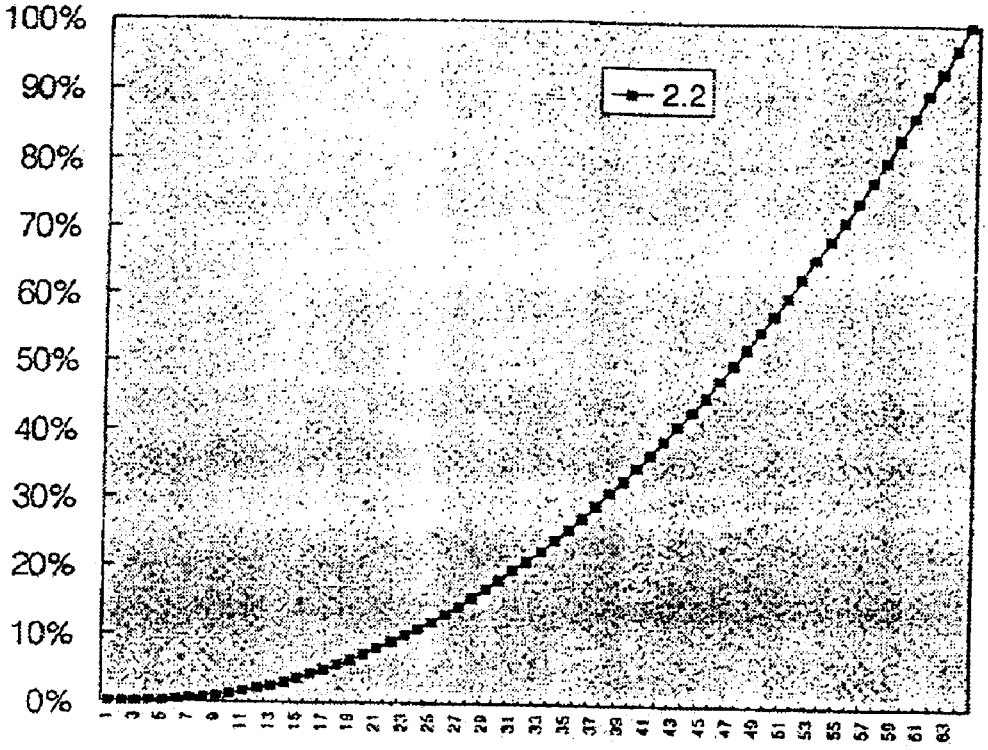
FIG. 6 Related Art
FIG. 6 shows a gray curve obtained by a fixed gamma voltage according to the related art.
Figure 7:
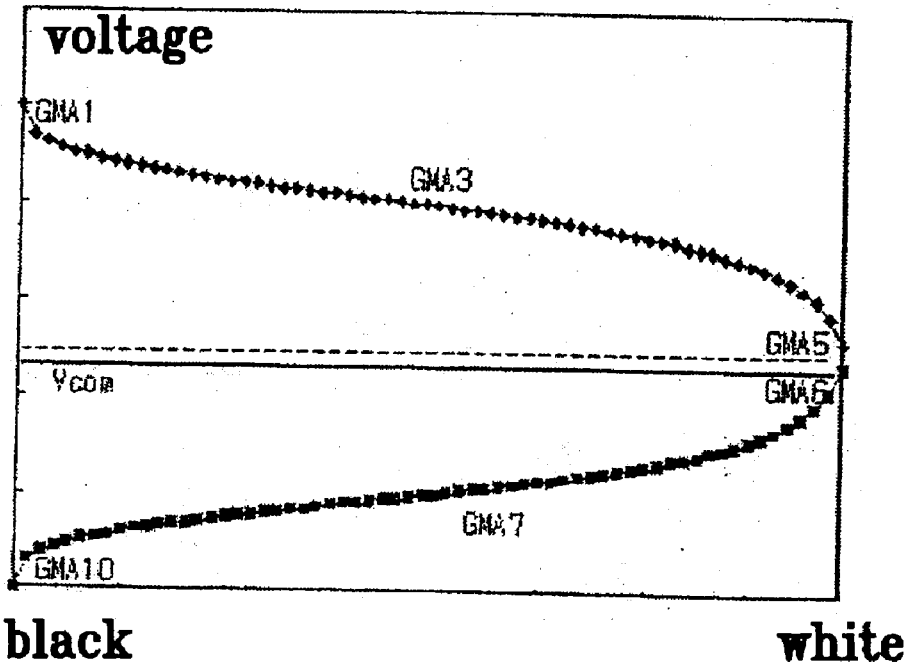
FIG. 7 Related Art
FIG. 7 shows a voltage applied to a liquid crystal panel according to a gray scale by a reference voltage of a gamma voltage generator and a resistor string for generating a gamma voltage through voltage division according to the related art.
Figure 8:
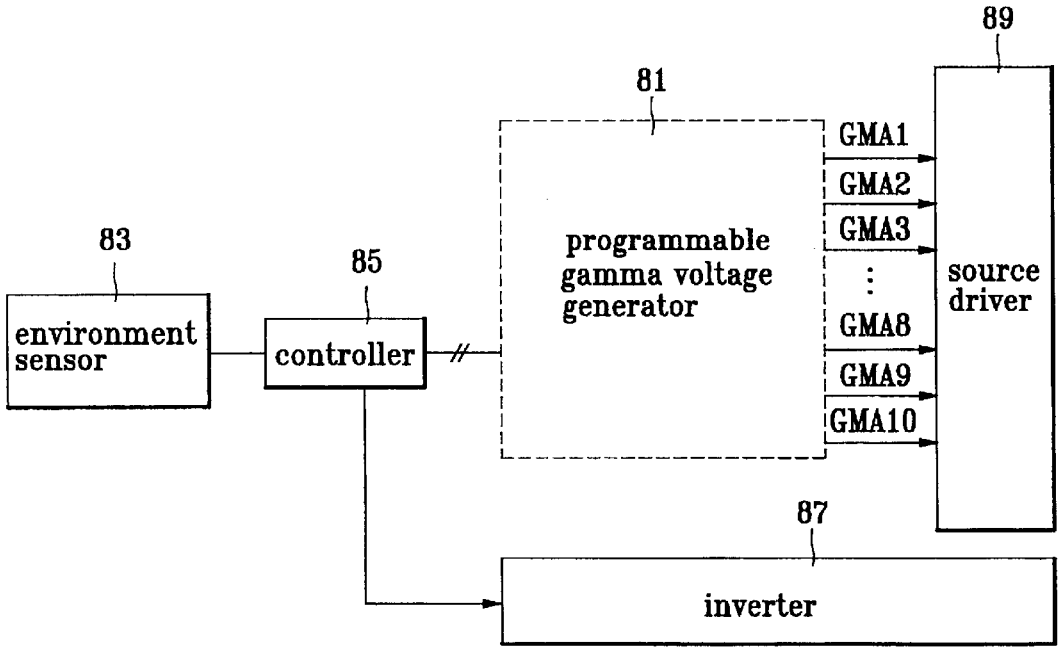
FIG. 8 is a block diagram of a driving circuit of a LCD device according to an embodiment of the present invention.

FIG. 8 is a block diagram of a driving circuit of "a" LCD device according to an embodiment of the present invention.

As shown in FIG. 8, the driving circuit of the LCD device according to an embodiment of the present invention includes a programmable gamma voltage generator 81, an environment sensor 83 sensing peripheral environments, a controller 85 controlling the programmable gamma voltage generator 81 in accordance with the sensed result of the environment sensor 83, and an inverter 87.

In the driving circuit of the LCD device, the controller 85 controls the programmable gamma voltage generator 81 using information input from the environment sensor 83, so that the programmable gamma voltage generator 81 generates a gamma voltage adapted to the environment sensed by the environment sensor 83.

Figure 9:
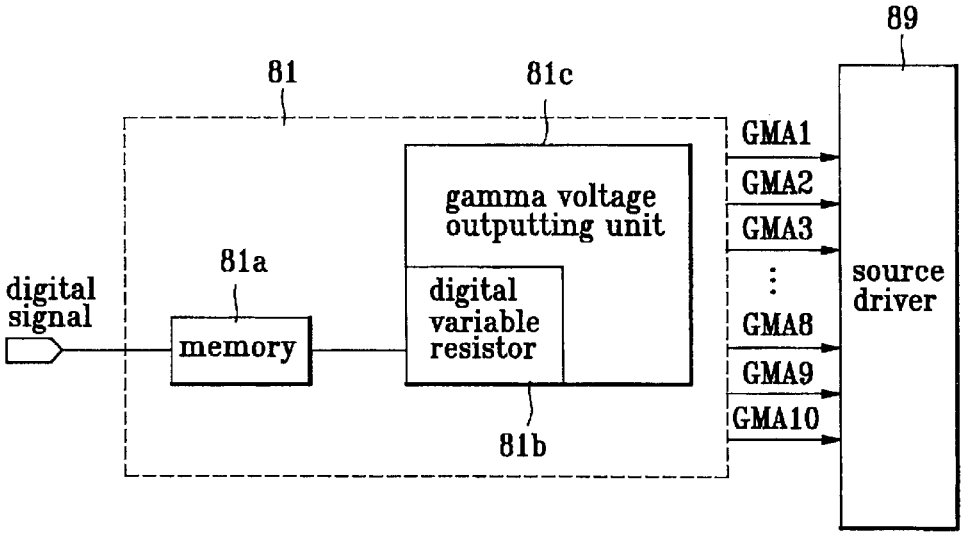
FIG. 9 is a schematic view of a programmable gamma voltage generator of FIG. 8.

FIG. 9 Shows the programmable gamma voltage generator 81 generating a gamma voltage adapted to the environment sensed by the environment sensor 83 under the control of the controller 85.

The programmable gamma voltage generator 81 according to an embodiment of the present invention includes a memory 81*a* dividing the peripheral environment into a plurality of modes and storing information of each mode. A digital variable resistor 81*b* adjusts a resistance value to correspond to mode information output from the memory 81*a*, and a gamma voltage outputting unit 81*c* outputs a plurality of gamma voltages GMA1–GMA10 corresponding to the resistance value adjusted by the digital variable resistor 81*b* to the source driver 89.

The memory 81*a* is an EEPROM (electronically erasable programmable read only memory), and may be provided inside or outside the programmable gamma voltage generator.

The memory 81*a* divides information of the peripheral environment into a plurality of modes so that the gamma voltage finally output to the source driver is adapted to the peripheral environment. The memory 81*a* stores information corresponding to each mode and outputs corresponding information in accordance with a control signal of the controller 85.

The output information corresponds to the peripheral environment sensed by the environment sensor 83. The environment sensor 83 senses the current peripheral environment and outputs the sensed resultant value to the controller 85.

The controller 85 designates an address that stores information corresponding to the peripheral environment sensed by the environment sensor 83 among the information stored in the memory 81*a* based on information input from the environment sensor 81.

The digital variable resistor 81*b* adjusts a resistance value for adjusting gamma voltages based on digital information corresponding to the peripheral environment information output from the memory 81*a*.

The number of the gamma voltages is determined by the number of digital data bits. In an embodiment of the present invention, if it is assumed that the digital data has 6 bits, then 10 gamma voltages from GMA1 to GMA10 are generated.

The operation of the driving circuit of the LCD device according to an embodiment of the present invention will be described below.

First, to maintain a stable display quality of the LCD device, exact and stable gamma voltages should be provided to the source driver 89. The gamma voltages GMA1–GMA10 are set in accordance with a LCD module. The set gamma voltages are transmitted to the source driver 89 so that picture images are displayed in the LCD panel.

At this time, if the peripheral environment is changed, the environment sensor 83 senses the changed peripheral environment and then outputs information about the current environment to the controller 85. The controller 85 designates an address of the memory 81*a* based on information input from the environment sensor 83. Namely, since the memory 81*a* sets the peripheral environment in a plurality of modes and stores information for each mode, the controller 85 designates an address of the memory 81*a* that stores mode information corresponding to the peripheral environment sensed by the environment sensor 83.

Then, the memory 81*a* outputs digital information stored in the designated address. The digital variable resistor 81*b* adjusts a resistance value to correspond to the digital information output from the memory 81*a*. The gamma voltages are determined at levels from GMA1 to GMA10 in accordance with the adjusted resistance value.

Meanwhile, the controller 85 outputs a dimming control signal corresponding to a proper brightness mode to the inverter 87 so that contrast and brightness according to variation of peripheral luminous intensity can be obtained.

Once the generated gamma voltages GMA1–GMA10 are supplied to the source driver 89, the same voltage is applied to each of R, G, and B pixel electrodes, and the liquid crystal is driven depending on the applied voltage, thereby obtaining corresponding brightness of light.

Figure 10:
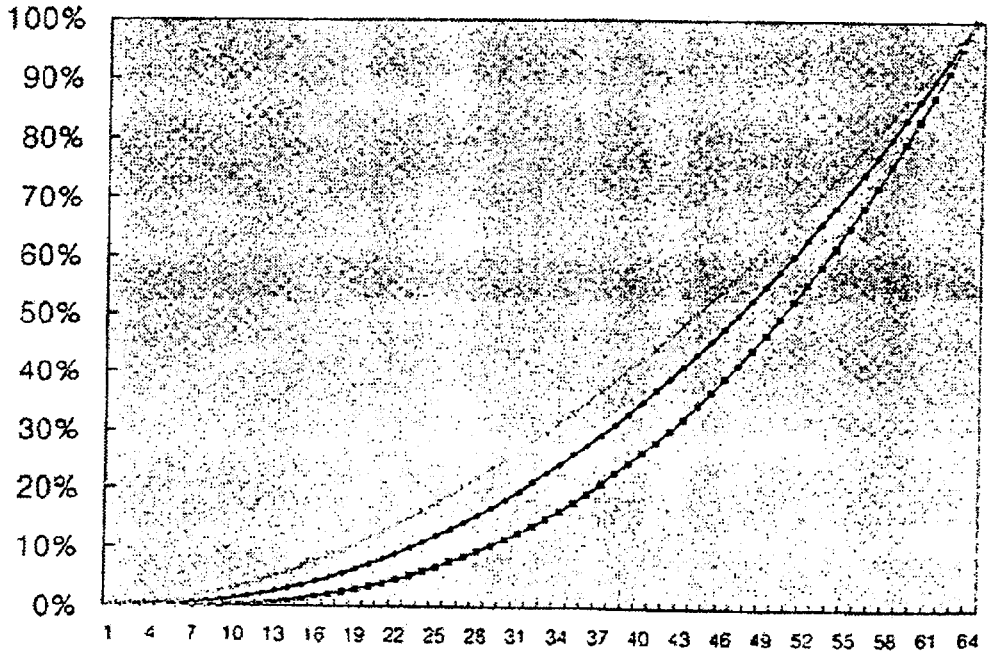
FIG. 10 shows a gray curve obtained by various gamma voltages according to an embodiment of the present invention.

In the above-described driving circuit of the LCD device according to the present invention, as shown in FIG. 10, the gamma voltages are adjusted in accordance with the peripheral environment so that various gray curves can be obtained. Also, contrast and brightness corresponding to the peripheral environment can be obtained.

It is to be understood that the foregoing descriptions and specific embodiments shown herein are merely illustrative of the best mode of the invention and the principles thereof, and that modifications and additions may be easily made by those skilled in the art without departing for the spirit and scope of the invention, which is therefore understood to be limited only by the scope of the appended claims.

What is claimed is:

1. A driving circuit of an LCD device comprising:

a memory dividing a peripheral environment into a plurality of modes and storing information of each mode;

an environment sensor sensing variation of the peripheral environment;

a controller selecting information of a mode corresponding to a resultant value sensed by the environment sensor among information of each mode;

a digital variable resistor adjusting a resistance value to correspond to mode information selected by the controller; and a gamma voltage outputting unit outputting a plurality of gamma voltages corresponding to the resistance value adjusted by the digital variable resistor.

2. The driving circuit of claim 1, wherein the memory is an EEPROM.

3. The driving circuit of claim 1, wherein the digital variable resistor and the gamma voltage outputting unit comprise a programmable gamma voltage generator.

4. The driving circuit of claim 3, wherein the memory is provided inside the programmable gamma voltage generator.

5. The driving circuit of claim 3, wherein the memory is provided outside the programmable gamma voltage generator.

6. The driving circuit of claim 1, wherein digital data has 6 bits, and 10 gamma voltages are generated.

7. The driving circuit of claim 1, which further comprises and inverter connected to the controller.

8. The driving circuit of claim 1, wherein the gamma voltages are applied to R, G and B pixel electrodes.

9. A LCD device, which comprises:

a liquid crystal display;

a source driver driving the liquid crystal display;

a memory dividing a peripheral environment into a plurality of modes and storing information of each mode;

an environment sensor sensing variation of the peripheral environment;

a controller selecting information of a mode corresponding to a resultant value sensed by the environment sensor among information of each mode;

an inverter connected to the controller;

a digital variable resistor adjusting a resistance value to correspond to mode information selected by the controller; and a gamma voltage outputting unit outputting a plurality of gamma voltages corresponding to the resistance value adjusted by the digital variable resistor.

10. The LCD device of claim 9, wherein the memory is an EEPROM.

11. The LCD device of claim 9, wherein the digital variable resistor and the gamma voltage outputting unit comprise a programmable gamma voltage generator.

12. The LCD device of claim 11, wherein the memory is provided inside the programmable gamma voltage generator.

13. The LCD device of claim 11, wherein the memory is provided outside the programmable gamma voltage generator.

14. The LCD device of claim 9, wherein digital data has 6 bits, and 10 gamma voltages are generated.

15. The LCD device of claim 9, wherein the gamma voltages are applied to R, G and B pixel electrodes.

16. A method for driving a LCD device, which comprises:

dividing a peripheral environment, with a memory, into a plurality of modes and storing information of each mode;

sensing variation of the peripheral environment with an environment sensor;

selecting, with a controller, information of a mode corresponding to a resultant value sensed by the environment sensor among information of each mode;

adjusting a resistance value, using a digital variable resistor, to correspond to mode information selected by the controller; and outputting a plurality of gamma voltages corresponding to the resistance value adjusted by the digital variable resistor, the outputting being performed with a gamma voltage outputting unit.

17. The method of claim 16, wherein the memory is an EEPROM.

18. The method of claim 16, wherein digital data has 6 bits, and 10 gamma voltages are generated.

19. The method of claim 16, wherein the gamma voltages are applied to R, G and B pixel electrodes.

20. The method of claim 16, wherein the digital variable resistor and the gamma voltage outputting unit comprise a programmable gamma voltage generator.

* * * * *